United States Patent [19]

Parker et al.

[11] Patent Number: 4,524,683

[45] Date of Patent: Jun. 25, 1985

[54] METHOD OF IMPROVING THE HANDLING OF TOBACCO

[75] Inventors: Samuel S. Parker; Charles W. Marshall, both of Maysville, Ky.; Durward G. Money, Aberdeen, Ohio

[73] Assignee: Parker Tobacco Company, Inc., Maysville, Ky.

[21] Appl. No.: 569,045

[22] Filed: Jan. 9, 1984

[51] Int. Cl.[3] ..... B65B 13/20

[52] U.S. Cl. ..... 100/3; 100/7; 100/99; 100/100; 100/264; 177/139; 414/21; 414/620; 414/786

[58] Field of Search ..... 100/1, 2, 3, 34, 100, 100/264, 99, 7, 25; 177/136, 139, 141; 414/21, 620, 786

[56] References Cited

U.S. PATENT DOCUMENTS

| | | | |
|---|---|---|---|
| 2,812,708 | 11/1957 | Tillinghast | 100/3 X |
| 2,875,912 | 3/1959 | Thresher | 100/100 X |
| 3,063,576 | 11/1962 | Hofmeister | 177/141 X |
| 3,228,166 | 1/1966 | Thiele | 100/3 X |
| 3,459,119 | 8/1969 | Wiklund | 100/7 |
| 3,561,191 | 2/1971 | Walsh | 100/100 X |
| 3,828,662 | 8/1974 | Pinkham | 100/100 X |
| 4,116,349 | 9/1978 | Durham | 100/100 X |

FOREIGN PATENT DOCUMENTS

| | | | |
|---|---|---|---|
| 2115769 | 9/1983 | United Kingdom | 100/3 |

OTHER PUBLICATIONS

Brochure entitled "Cascade D-Series Bale Clamps", Jun. 1982.

*Primary Examiner*—Billy J. Wilhite
*Attorney, Agent, or Firm*—Wood, Herron & Evans

[57] ABSTRACT

Method and apparatus for handling tobacco. Five to eight bales are compacted to reduce the transverse dimension of the bales, the compacted group being tied into a single pack. The disclosed apparatus for performing the method consists of a truck having a pair of jaws which are movable toward one another, which are rotatable and which are elevatable to permit the bales to be compressed, raised, rotated through 90° and tied.

5 Claims, 5 Drawing Figures

METHOD OF IMPROVING THE HANDLING OF TOBACCO

This invention relates to apparatus for improving the handling of tobacco as it is being marketed.

The process of handling tobacco from the farmer to the manufacturer of tobacco products is generally as follows:

The farmer cuts the tobacco and hangs it in a barn on a horizontal stick, six stalks to a stick. There, the tobacco "cures out", that is to say, the water in it evaporates. When the tobacco is cured out, the farmer, at the barn, strips the tobacco by taking the leaves off the stalk. There are on average three grades of tobacco leaves on a stalk. The lower leaves are called trashes and lugs. The middle leaves are called cutter and leaf. The upper leaves are called tips. The farmer places each grade in a respective bale box which is rectangular, being 4 feet high, 3 feet long and 1 foot across the bottom. The leaves are placed with the stem or butt ends out with the tips in the middle of the bale box. They are laid flat and pressed to about 2 feet high with a hydraulic press. When the bale box is filled, the bales are tied with strings previously placed in the bale box to form separate bales. Each bale weighs between 40 and 120 pounds, averaging about 70 pounds.

When the farmer gets a truckload of bales, he brings it to the warehouse. The bales are usually stacked on a pallet with 5, 6, 7 or 8 bales of a particular grade being placed on the pallet. The bales are laid on the 3'×2' sides so that the leaves are standing on their edges, that is, they are in generally vertical planes. The pallet and bales are weighed in by the warehouseman. The estimated weight of the pallet is subtracted, or the scales are set previously to automatically exclude the pallet as permitted by the Weights and Measures Bureau, and the weight of the tobacco is noted on a sheet which is placed with the particular pallet along with the farmer's name. A tag containing a "unique number" contains that information and smaller tags with the unique numbers are stapled to each individual bale.

About one hour before the auction, a Government inspector grades each pallet of tobacco. He has about 106 grades, one of which is applied to the pallet of tobacco and that grading establishes the Government guaranteed price. The pallet load weighing up to about 700 pounds is auctioned off. If no one bids the guaranteed price or greater, the auctioneer "knock it out to pool," meaning that it goes to a cooperative and is financed by the Federal Government until purchased at some later date.

The Government as well as the manufacturer of tobacco products hire tobacco processing companies to get the tobacco from the warehouse, where it has been auctioned, to the manufacturer's plant. It can be shipped to the plant either in the original bales or after further processing at the election of the purchaser.

The warehousemen, using forklift trucks, carry the pallets to a loading area assigned to the tobacco processor. The pallets are loaded by the processor onto his truck and taken to the green prizery. At the prizery the pallets are taken from the truck and placed on scales and reweighed. If the weight differs by an amount greater than 2% from the weight recorded at the warehouse, the warehouseman would be made aware of the weight discrepancy immediately.

The processor cuts the strings on the bales and places the tobacco leaves in a hogshead which is a huge barrel-shaped container about 4 feet in diameter. A hydraulic press packs the tobacco in the hogshead for shipment to distant parts of the United States. This process is known as "gren prizing" in the tobacco industry. If the manufacturer of tobacco products is close at hand, the pallets can be shipped directly without the intermediate packing in a hogshead, but if the manufacturer is at some distance from the warehouse, it is economical to pack in the hogshead so that the truck can haul a greater weight of tobacco.

It has been an objective of the present invention to provide a method and apparatus for substantially improving the economics of handling tobacco from the warehouse to the tobacco product manufacturer.

This objective of the invention is attained by compacting the 5 to 8 bales of tobacco at the warehouse and strapping the compact package so that it can be handled as a single unit.

One form of apparatus for compacting consists of a forklift truck having a pair of jaws movable together under a force of at least 2,000 pounds, the jaws being rotatable through an arc of at least 180°. A scale is located between the jaws and the truck and a digital weight readout is placed in the cab of the truck. The jaws are about 4×4 and have two opposing transverse slots in the faces of the jaws.

With this truck, the operator can engage two sides of a stack of bales and press the bales together in a direction perpendicular to the plane of the tobacco leaves. The jaws are raised and rotated through 90° so as to bring the slotted faces of the jaws to a horizontal attitude. Tying straps or ropes are passed through the slots in the faces of the jaws in order to wrap the bales and securely tie them.

At the time of tying, the scale between the jaws and the truck enables the operator to weigh the group of bales absent the pallet. Further, the operator is able to rotate the jaws through another 90° to expose the bottom of the bottom two bales so that a check can be made to see that the grade of the bottom bales matches the grade of the top bales on which the price of the tobacco is based.

At this stage, a number of significant advantages are derived. First, the pack is immediately weighed so that if there is a greater than 2% discrepancy, that fact can be brought immediately to the attention of the warehouseman and appropriation action can be taken to satisfy the discrepancy of the weight of tobacco to make up the difference. Second, the weighing is done without the pallet and hence errors in the estimated weight of the pallet are eliminated. Third, if the bottom inspection shows an inferior grade, that too can be immediately brought to the attention of the warehouseman so that the purchase can be cancelled.

Fourth, a semi-trailer can only carry about 18,000 to 20,000 pounds of pallet-loaded bales. The same semi-trailer container will hold from 30,000 to 38,000 pounds of the compressed, depalletized packs. Fifth, the loading and unloading time is significantly improved because there are no loose bales able to fall off pallets. Sixth, at the processor's plant, considerable floor space can be saved. For example, in one plant, 6 to 7 million pounds of tobacco can be stored, whereas in the palletized form only about 1½ million pounds could be stored.

Seventh, since the tobacco is now in a compressed shipable form, the whole process employing hogsheads is eliminated and the expense of shipped hogshead in order to ship the tobacco is eliminated. Eighth, the operation at the green prizery where weighing and packing in the hogsheads is performed is totally eliminated, thereby eliminating the need for the paying of utility bills, the labor cost, the step of driving the tobacco to the prizery, the supervisor's time, the labor to recieve, pack and ship, etc.

Ninth, the invention keeps the bales in a single unit from the time they are tied and placed on the warehouse floor until the pack reaches the factory for processing.

These several features and advantages of the invention will become more readily apparent from the detailed description taken in conjunction with the accompanying drawings in which.

Figure 1:
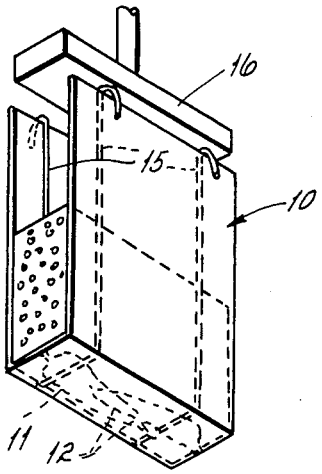
FIG. 1 is diagrammatic illustration of a farm bale box with tobacco leaves being placed in it.
Figure 2:
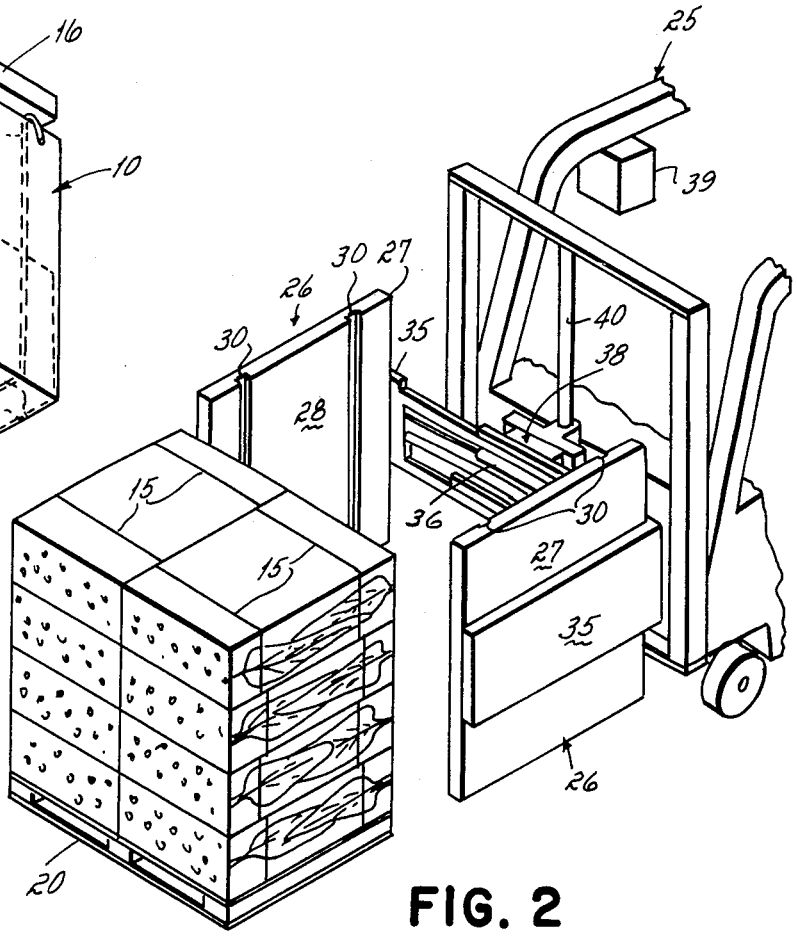
FIG. 2 is a diagrammatic illustration of a pallet load of tobacco bales and the apparatus for handling them.
Figure 3:
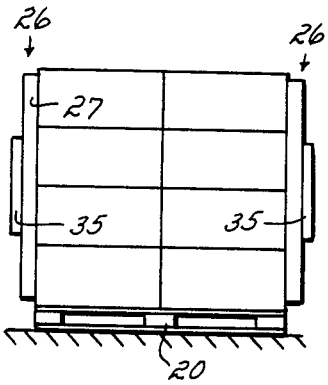
FIGS. 3–5 are diagrammatic illustrations of the steps of compressing the bales and tying the bales into a compact group.

Referring to FIG. 1, a bale box is indicated generally at 10. Tobacco leaves 11 are laid flat in the bale box with their tips 12 overlapping at the center of the bale box and their stems projecting out at the end of the bale box. The bale box is 3 feet high, 1 foot in transverse dimension and 2 feet in longitudinal dimension. Tying strings 15 are laid in the bale box prior to the placing of the leaves in it. A pneumatically- or hand-driven platen 16 engageable with the top of a stack of tobacco leaves compresses the tobacco leaves into the bale box. In the compressed state, the tobacco leaves are tied using the strings 15, thereby forming a rather loosely-tied bale of tobacco leaves.

The tobacco farmer forms the bale. He loads his bales into his truck and transports them to the warehouse. At the warehouse, the bales are stacked onto pallets 20 with the tobacco leaves in a vertical orientation. In this sense, each bale is laid on its side when compared to the orientation of the bale when it is in the bale box. The bales may be stacked three high or four high, thereby making a group of five to eight bales. The size of the group of bales is roughly 3 feet high, in the case of six bales, and 4 feet wide.

The bales are weighed by the warehouseman and the warehouseman, using a forklift truck, places the palletized bales in long lines at the warehouse ready for auction. Each pallet is given a "unique number" and a tag is fastened to each bale bearing the unique number.

Just priór to the auction, each pallet of bales is graded by a Government inspector. The grading determines the guaranteed price of the tobacco.

After the auction, the bales are removed by a processor or by the purchaser. It is at this point that the method and apparatus of the present invention comes into use.

The apparatus of the invention includes a truck 25 similar to a forklift truck. The forklift truck is modified to provide a pair of jaws 26. Each jaw consists of a flat plate 27, usually made of wood, which has flat surfaces 28. A pair of transverse grooves 30 is formed in each flat surface, the grooves of respective jaws being opposed to each other so as to permit the passage of ties around the group of bales.

The plates are mounted on brackets 35, the brackets being slidably mounted on the lift truck. A hydraulic piston and cylinder 36 is provided for driving the jaws together to apply a compression force of about 2,000 pounds to the bales.

The assembly of brackets, jaws and hydraulic piston and cylinder are mounted on a device 38 for rotating the jaws through at least 90° and preferably 180°.

A scale supports an assembly of jaws and rotating mechanism, the scale having a digital readout 39 inside the cab of the truck 25. Finally, a post 40 having a conventional lifting mechanism associated with forklift trucks is provided to lift the whole assembly.

Figure 4:
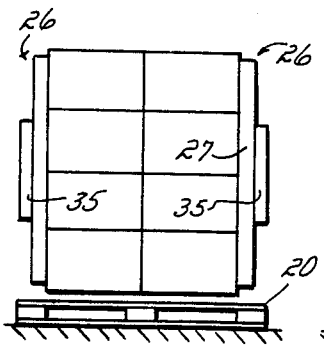

In the operation of the apparatus, the truck 25 with jaws extended is driven to a position in which the jaws embrace the group of bales above the pallet 20. The jaws are driven toward each other to compress the bales at a force of about 2,000 pounds. See FIG. 4. By way of example, a stack that is 48" wide is compressed to about 36" to 40".

Figure 5:
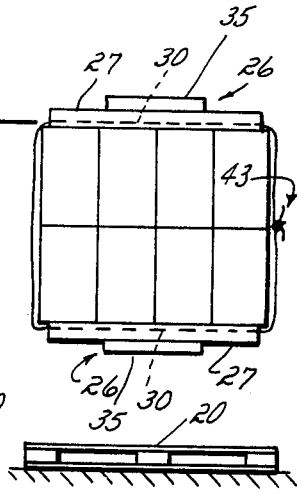

The lift mechanism is actuated to raise the assembled, compressed bales a few inches off the floor sufficient to enable the jaws to be rotated through 90°. The jaws are rotated through 90° to bring the assembly to the attitude illustrated in FIG. 5. In this attitude, tie ropes may be inserted through the slots 30 by means of elongated rods 42 with the ends of the tie rope being tied as at 43. Alternatively, conventional straps may be employed.

Either prior to the tying or after the tying, the weight of the group of bales is determined. Previously, of course, the operator has "zeroed" the scale. Alternatively, the scale can be "zeroed" or "tared" and the bale released, thereby giving a negative reading which would be equivalent to the weight of the group of bales.

Preferably before releasing the group of bales, the lower side of the group should be inspected to be sure that the tobacco is of substantially the same quality as that which was inspected at the upper side of the group of bales.

These tied groups of bales are placed at the warehouse dock suitable for transportation.

The advantages of the method and apparatus are apparent. The pack or group of bales is weighed at the warehouse so that if there is a discrepancy that discrepancy can immediately be taken up with the warehouseman and resolved. Second, the weighing is done without the pallet being present. Thus, discrepancies in the weight of the pallet are eliminated.

The bottom inspection enables the purchaser or processor to determine whether the quality of the tobacco is substantially uniform throughout the pack.

The truck or semitrailer can haul greater loads and the loads can be packed more efficiently using the compact packages resulting from the invention as contrasted to the handling of loose bales on pallets.

At the plant of the processor or manufacturer of tobacco products, the floor space required to inventory the tobacco is significantly lessened because of the absence of pallets and because of the compact condition of the group of bales.

The need for the packing of tobacco into hogsheads is eliminated. The operation at the green prizery wherein the pallet loads of bales had previously been weighed, broken apart and packed into hogsheads is also eliminated.

Having described our invention, we claim:

1. A method of compressing and banding bales of oriented tobacco leaves without altering leaf orientation in the bales, the leaves in the bales being oriented parallel to the bases of the bales, comprising:

assembling a stack of bales on a pallet or other surface with all the bales turned so that the leaves therein are on edge and vertical to the support;

engaging two opposite sides of the stack so formed by vertical clamping platens mounted to the jaws of a forklift truck, the platens being placed parallel to the planes of the leaves in the bales;

pressing the stack between the platens by bringing the platens closer together in the direction perpendicular to the planes of the leaves, and compressing the leaves in the direction perpendicular to their planes;

raising the jaws while holding the stack of bales compressed between the clamps, thereby lifting the stack from the surface;

rotating the jaws, with the stack between them, so that the platens and leaves are then essentially horizontal;

passing strapping bands or ties around the stack through grooves in the platens adjacent the bales while the bales are still compressed, and securing the bands or ties to hold the bales in a compressed state;

turning the jaws, while still supporting the stack, back to an orientation in which the leaves are again vertical and on edge; and releasing the compressed and banded stack from between the platens.

2. The method of handling tobacco at a warehouse comprising the steps of;

stacking a group of five to eight tobacco bales on a pallet, the tobacco leaves lying generally in vertical planes;

grading the tobacco;

horizontally compressing the group of bales;

tying the group of bales so that when the compressive force is relieved, the bales will remain in a compact group;

and weighing the group of bales absent said pallet.

3. The method as in claim 2 further comprising the intermediate step of rotating the compressed bales about horizontal axis through about 90° to facilitate tying the bales.

4. The method as in claim 2 wherein said tobacco bales are compressed between the jaws of a truck;

said group of tobacco bales being weighed while supported off the pallet between the jaws of the truck;

whereby the truck can perform the multiple functions of compressing the group of bales, weighing the group of bales and transporting the group of bales to areas in the warehouse.

5. The method as in claim 4 wherein said group of bales is tied by passing tie ropes through opposed grooves on the faces of the jaws of the truck.

* * * * *